US008327918B2

(12) United States Patent
Seidel et al.

(10) Patent No.: US 8,327,918 B2
(45) Date of Patent: Dec. 11, 2012

(54) METHOD FOR THE PRODUCTION OF A STRIP MADE OF STEEL

(75) Inventors: Juergen Seidel, Kreuztal (DE); Ernst Windhaus, Duisburg (DE); Markus Reifferscheid, Korschenbroich (DE); Juergen Mueller, Kaarst (DE)

(73) Assignee: SMS Seimag AG, Duesseldorf (DE)

( * ) Notice: Subject to any disclaimer, the term of this patent is extended or adjusted under 35 U.S.C. 154(b) by 71 days.

(21) Appl. No.: 12/733,041

(22) PCT Filed: Jul. 31, 2008

(86) PCT No.: PCT/EP2008/006316

§ 371 (c)(1),
(2), (4) Date: Mar. 4, 2010

(87) PCT Pub. No.: WO2009/018957

PCT Pub. Date: Feb. 12, 2009

(65) Prior Publication Data

US 2010/0163205 A1 Jul. 1, 2010

(30) Foreign Application Priority Data

Aug. 4, 2007 (DE) ..... 10 2007 036 967
Dec. 6, 2007 (DE) ..... 10 2007 058 709

(51) Int. Cl.
*B22D 11/20* (2006.01)
*B22D 11/128* (2006.01)
*B22D 11/16* (2006.01)

(52) U.S. Cl. ..... 164/454; 164/155.3; 164/155.6; 164/413; 164/452; 164/484; 72/6.2; 72/10.4; 72/19.1

(58) Field of Classification Search ..... 164/155.4, 164/155.6, 417, 476, 413, 454, 484, 155.3, 164/155.5, 452; 72/6.2, 10.4, 19.1
See application file for complete search history.

(56) References Cited

U.S. PATENT DOCUMENTS

| | | | | |
|---|---|---|---|---|
| 3,332,263 | A * | 7/1967 | Beadle et al. | 72/8.9 |
| 3,433,037 | A * | 3/1969 | Lemon | 72/31.08 |
| 3,722,244 | A * | 3/1973 | Fujii et al. | 72/11.8 |
| 4,379,396 | A * | 4/1983 | Hope et al. | 72/8.5 |
| 5,634,257 | A * | 6/1997 | Kajiwara et al. | 29/527.7 |
| 6,044,895 | A * | 4/2000 | Kuttner et al. | 164/155.4 |
| 6,092,586 | A * | 7/2000 | Schonbeck | 164/476 |
| 2008/0035301 | A1 | 2/2008 | Arvedi | |
| 2008/0135203 | A1 * | 6/2008 | Doll et al. | 164/157 |

* cited by examiner

*Primary Examiner* — Devang R Patel
(74) *Attorney, Agent, or Firm* — Abelman, Frayne & Schwab

(57) ABSTRACT

A method of fabricating a steel strip (1) including a) providing a functional relationship in a machine controller (8) between a slab casting speed (v) or the mass flow as a product of casting speed and strip thickness or as a product of strip speed and strip thickness and the strip temperature (t) downstream of the last rolling stand (7) for a different number (n) of active rolling stands (7) and different final thicknesses, b) determining or specifying the casting speed (v) or the mass flow (v×H) and feeding the determined value into the machine controller (8), and c) determining the optimum number of active rolling stands (7) and the final thicknesses and thickness reductions which can be rolled with them in the rolling train using the functional profiles.

13 Claims, 6 Drawing Sheets

METHOD FOR THE PRODUCTION OF A STRIP MADE OF STEEL

Figure 1:
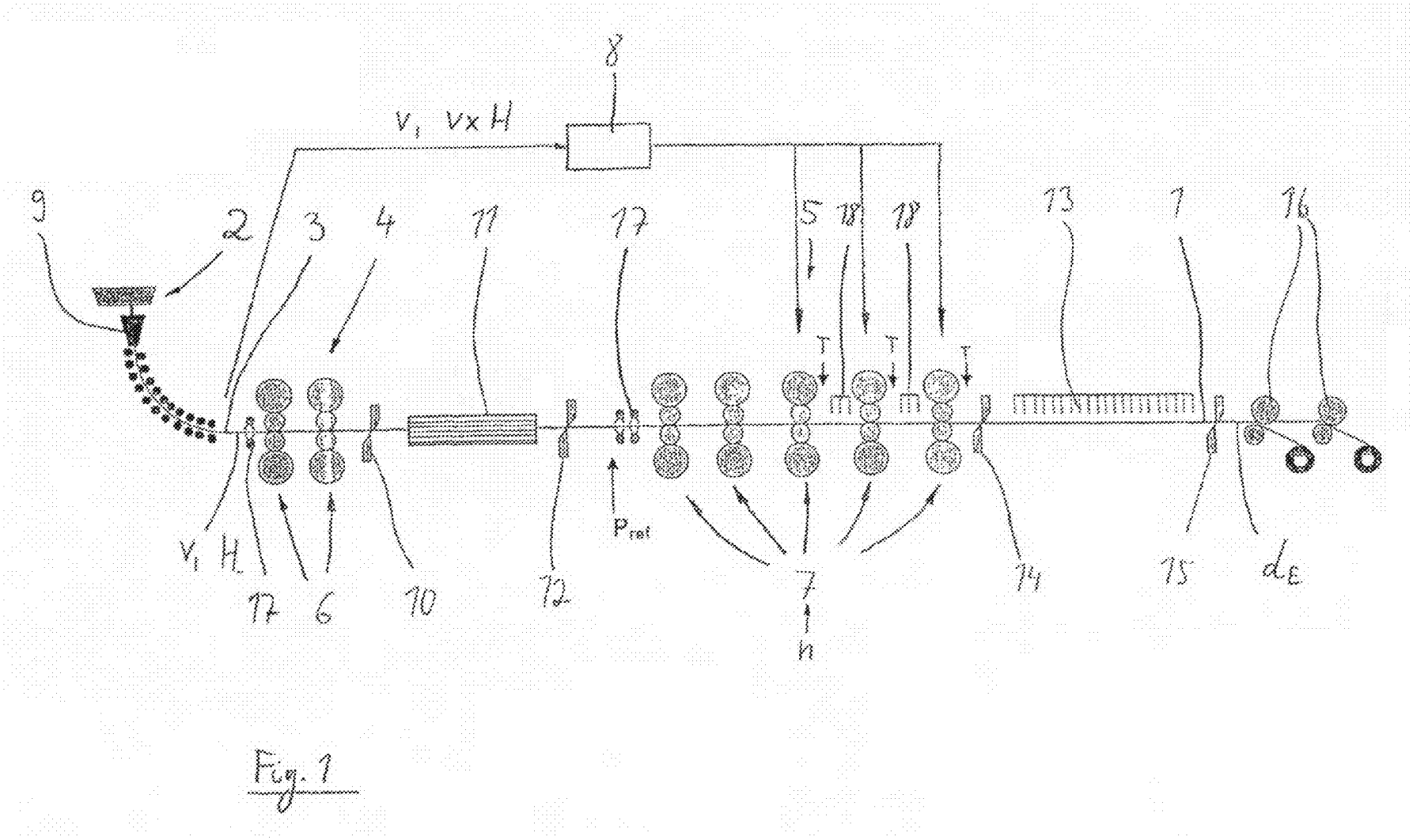

The invention relates to a method for fabricating a steel strip, in which firstly a slab is cast in a caster, with the slab then being rolled to form a strip in at least one rolling train and with the rolling train having a number of rolling stands.

Endless rolling from the hot cast metal when fabricating a steel strip is known. The greater the casting speed, the more interesting the method. The method is disclosed for example in EP 0 889 762 B1, WO 2006/106376 A1 and WO2007/073841 A1. Here, a slab is firstly fabricated in a continuous caster, which slab emerges vertically downwards from a mould and is then redirected in the horizontal direction. The still hot strip is then fed to a rolling train. The thickness of the slab is reduced in the rolling stands of the rolling train until the strip is fabricated at the desired thickness.

Steel strips are needed in various thicknesses for a wide variety of applications.

The advantages of this method of endless cast rolling lie in the relatively short construction length of the installation and together with this lower investment costs. Furthermore, energy can be saved during strip fabrication. At low rolling speeds there is also a lower strip deformation resistance. It is possible to manufacture products which are difficult to roll, for example very thin strips (thicknesses of for example 0.8 mm), to process high strength special materials, and to fabricate wide and thin strips in a combined manner. Furthermore, strip end misrolling and thus rolling damage can be better avoided. Finally, the interruption rate is low, there are in particular fewer fold defects.

In the said documents EP 0 889 762 B1 and WO2007/073841 A1, the casting and rolling processes are directly coupled. There is no material buffer between the casting process and the rolling process. The endless strip can be cut with shears shortly before the winders. In order to improve the temperature level at the relatively low strip speed, heaters can be provided upstream of or within the rolling train.

The said technology is also referred to as CSP technology. This is to be understood as the manufacture of a steel strip in a thin slab thin strip cast rolling installation which allows efficient production of hot-rolled strip if the rigid connection of continuous casting installation and rolling train and its temperature behaviour through the installation as a whole is controlled.

In this case therefore the rolling stands are arranged directly downstream of the caster. After a few (for example two or three) roughing stands, intermediate heating to a defined intermediate temperature takes place at a reference point or reference position upstream of a finishing train with n stands. A further deformation to the final thickness of the strip then takes place in subsequent stands. Shears can be arranged upstream of the finishing stands for disposing of the starter bar or for chopping the strip (under certain operating conditions). For ensuring endless operation, shears can be necessary downstream of the rolling stands or upstream of a winder group for cutting to a desired strip weight. One set of shears is used directly upstream of the winder for thin strips and another set of shears is used for cutting thicker strips. Furthermore, the strip is cooled to a desired winding temperature on a runout table.

The use of the said cast rolling installation makes possible a coupled, fully continuous cast rolling process (endless rolling). The direct coupling of the two processes of casting and rolling however requires a high availability of the installation components. An interruption in casting must be avoided under all circumstances.

If in this case variations in the process occur—for example during feeding, interruptions, speed variations, etc.—or if the desired casting speed cannot be set for other reasons, then this has considerable negative consequences on the manufacture of the strip and its quality, so that considerable economic losses can occur.

The present invention is therefore based on the object of developing a method of the type mentioned in the introduction in such a manner that a continuous manufacturing process can be ensured during cast rolling, so that the proportion of strip of lower quality remains as low as possible while the availability of the installation remains high.

The solution of this object by the invention is characterised in that the method has the following steps:

a) providing a functional relationship in a machine controller between the casting speed or the mass flow as a product of casting speed and slab thickness or as a product of strip speed and strip thickness and the strip temperature downstream of the last rolling stand, which takes part in the deformation process, for a different number of active rolling stands and different final thicknesses;
b) determining or specifying the casting speed or the mass flow and feeding the determined value into the machine controller;
c) automatically determining the optimum number of active rolling stands and the final thicknesses and thickness reductions which can be rolled with them in the rolling train using the functional profiles stored in accordance with step a) in the machine controller in order to achieve a desired strip temperature downstream of the last active rolling stand at the given casting speed or at the given mass flow;
d) where necessary raising a number of rolling stands in the rolling train so that only the number of rolling stands determined in accordance with step c) are active.

The functional relationship according to step a) is in this case preferably obtained by means of a computer model. It should be noted here that the final strip thickness changes when the number of active rolling stands changes.

A development provides for the strip to be rolled to be heated upstream of a finishing train so that it has a defined intermediate temperature. It can also be provided for the strip to be rolled to be cooled at least between two rolling stands in the finishing train; in this case it is in particular intended for the strip to be cooled between the last rolling stands of the finishing train.

The temperature of the strip can be measured downstream of the last active rolling stand, and the measured value can be fed to the machine controller. The effective final strip temperature is thus available to the machine controller so that this can be influenced where necessary in the closed control loop.

The method is also suitable for meeting with particular events during cast rolling. A rolling stand can be raised afterwards if a predefined maximum differential rolling force is exceeded at it for a predefined time, with each raised rolling stand being taken into account in the above procedure. A rolling stand can also be raised if a predefined integral value of a differential rolling force is exceeded at it over the time, with the raised rolling stand being taken into account in the above procedure.

A rolling stand can also be raised if an unevenness is detected on the strip at this rolling stand, which unevenness exceeds a predefined amount, with each raised rolling stand being taken into account in the above procedure.

Furthermore, a rolling stand can also be raised if a surface marking is detected on the strip at this rolling stand, which surface marking exceeds a predefined amount, with each raised rolling stand being taken into account in the above procedure.

A variation of the proposal according to the invention provides for a roller change to be able to be carried out on a raised rolling stand while production continues.

Finally, if a rolling stand fails, it is possible for it to be raised, with each raised rolling stand being taken into account in the above procedure.

The invention therefore provides for rolling stands to be automatically opened (in particular the finishing stands downstream of the point $P_{ref}$), as a function of the casting speed or mass flow, in order to ensure a sufficiently high final rolling temperature so that the required properties of the material are also retained and the strips thus have a sufficiently high quality. A desired final strip thickness is therefore not worked towards, but rather a higher deviation thickness is predefined, with the high quality of the strip then being ensured and in particular no interruptions in the process being likely. The strip thickness produced is produced from the number of active (finishing train) rolling stands. The higher minimum final thickness is selected as a function of the rule of the profile of the strip thickness over the number of the activated rolling stands, or another thickness, which lies above this curve, is set according to the demand for the strip.

With endless rolling, the level of the casting speed determines the temperature profile through the whole installation. If the casting speed is too low, the desired finishing temperatures and thus the material properties cannot be retained. Accordingly, the invention proposes one possibility of how the framework conditions can be adapted to the process conditions—in particular to the casting speeds.

The rules to be applied, that is, the functional profiles, are stored in a computer model which is used for the control and regulation of the process.

If the casting speed or the mass flow falls below a certain predefined setpoint value, for example in the event of problems in the casting installation, in the event of materials which are difficult to cast, during the starting process or if the caster does not reach its predefined speed, (finishing) stands are opened and another target thickness of the strip is set. Furthermore, the heating apparatus can then be set within certain limits to an adapted level so that the necessary final rolling temperature is achieved.

Rolling can continue with open stands not only at low speeds in order to reach a target final rolling temperature, but also when certain events take place in the finishing train. In relation to this, the following can in particular be mentioned:

A possible case which can be reacted to according to the invention is the strip running out of the centre of the stand. If the differential rolling force exceeds a settable threshold value (for example 2,000 kN) and remains at this level for a likewise parameterisable, critical time (for example 1 sec), then there is a strong probability that a rolling incident will occur. This must be avoided so that an interruption in casting does not occur. After the problematic stand has been raised, there is a corresponding increase in the strip thickness in the subsequent stands. The parameters are changed according to the rules as are described below in FIG. 4 and FIG. 5. If the course of the strip has settled or the strip has become centred again, the working rollers are brought online and the stand is included in the rolling process again. Alternatively, an integral of the product of the differential rolling force and the critical time can also generally be used for a decision.

A further possible case is the observation or measurement of relatively large unevennesses of the strip. The procedure is analogous to the one above in the event of large unevennesses on one or both sides if the unevenness cannot be improved by other, quick methods—such as pivoting or using the curve of the working rollers.

A further application of the idea according to the invention concerns surface markings on the strip or working rollers. If surface markings on the strip are no longer to be accepted, the stand whose rollers are causing the defect or are damaged can be raised. That is, in particular as soon as a new strip starts, the corresponding stand is raised, the subsequent stands are adapted with regard to their thickness and a corresponding, different finishing thickness is selected for the strip and continues to be produced.

Furthermore, a roller change can also be carried out during production by means of the proposed procedure. If a roller change is absolutely necessary, it can be provided for the roller gap to be opened wide and a roller change to be carried out, with the method according to the invention being carried out. After the roller change, the working rollers are placed on a suitable point in the strip and included in the reduction process again, and the final rolling thickness, the final rolling speed and the temperature profile are adapted accordingly.

The proposed method can furthermore be used if a stand failure occurs. If for example the motor of a stand fails, the procedure can be as described above; the corresponding stand is then raised so that the damage to the stand does not have any serious adverse effects; it is rather manifested merely in a change in the strip thickness, with the strip however continuing to be manufactured to a flawless quality.

The corresponding applies in the case of a short-term failure or an interruption in the rolling train. If an interruption to the rolling cannot be avoided despite all precautionary measures, an automatic switch can be made to chopping mode until the interruption is rectified. That is, shears upstream of the finishing train chop the strip into small pieces or into plates of defined length during the interruption period until the problem is rectified.

A high degree of process reliability is produced by the parameters being switched or set in any desired manner, so that an interruption in casting can be avoided. This applies in particular during commissioning of the production installation and during rolling of critical products and dimensions.

The proposed method therefore creates essential advantages in casting speed changes for the purpose of retaining the desired or necessary final rolling temperature.

In the event of unexpected interruptions in the rolling train, an interruption in casting can be avoided with the proposed procedure.

In this case the relationship is used between the casting speed or mass flow, final rolling temperature and the number of stands used.

The cooling of the strip within the finishing train with open finishing stands advantageously creates an extended cooling zone.

Shears can be used during feeding or during the removal of strip partitions of unequal thickness.

Figure 2:
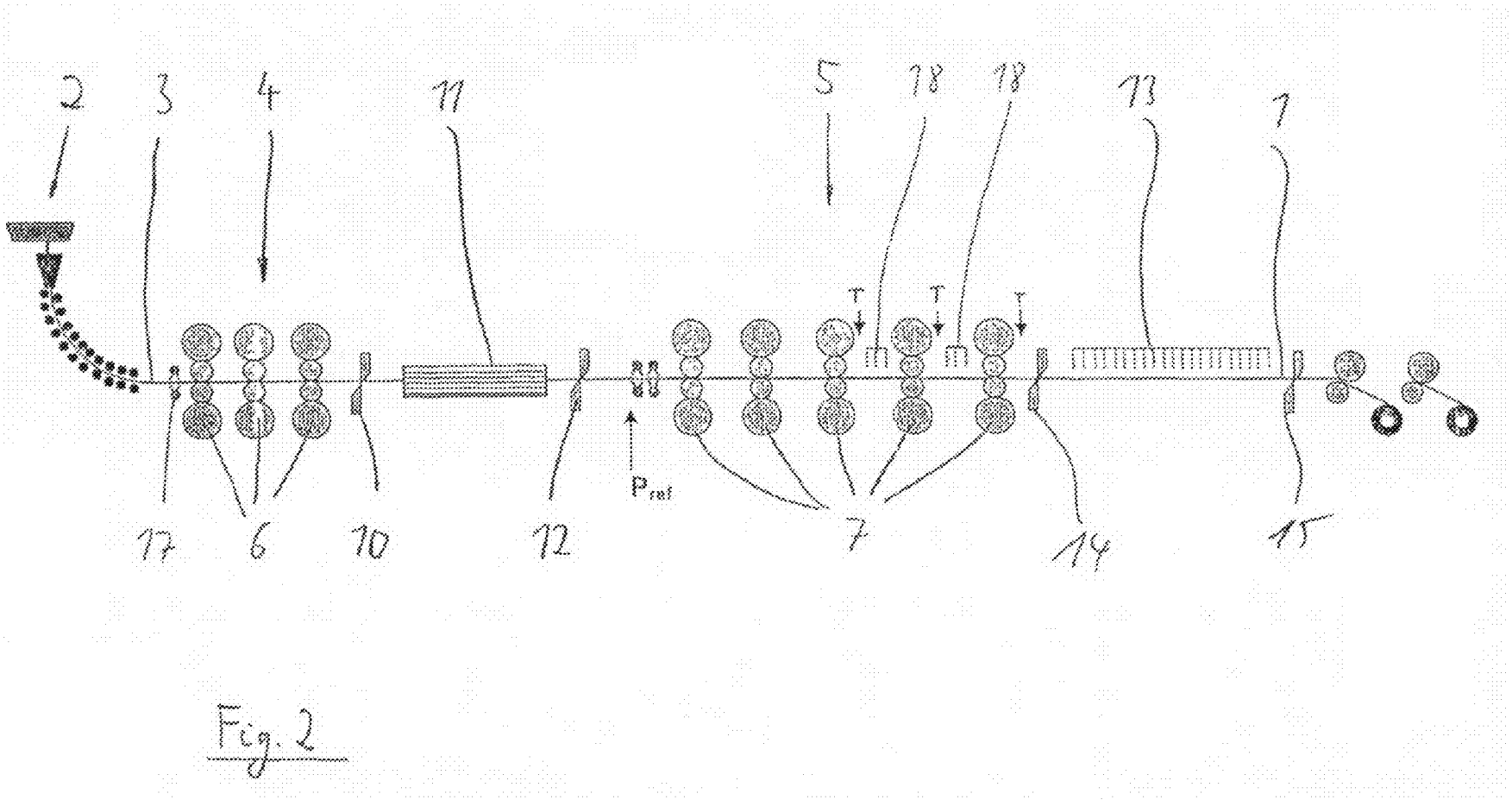
Figure 3:
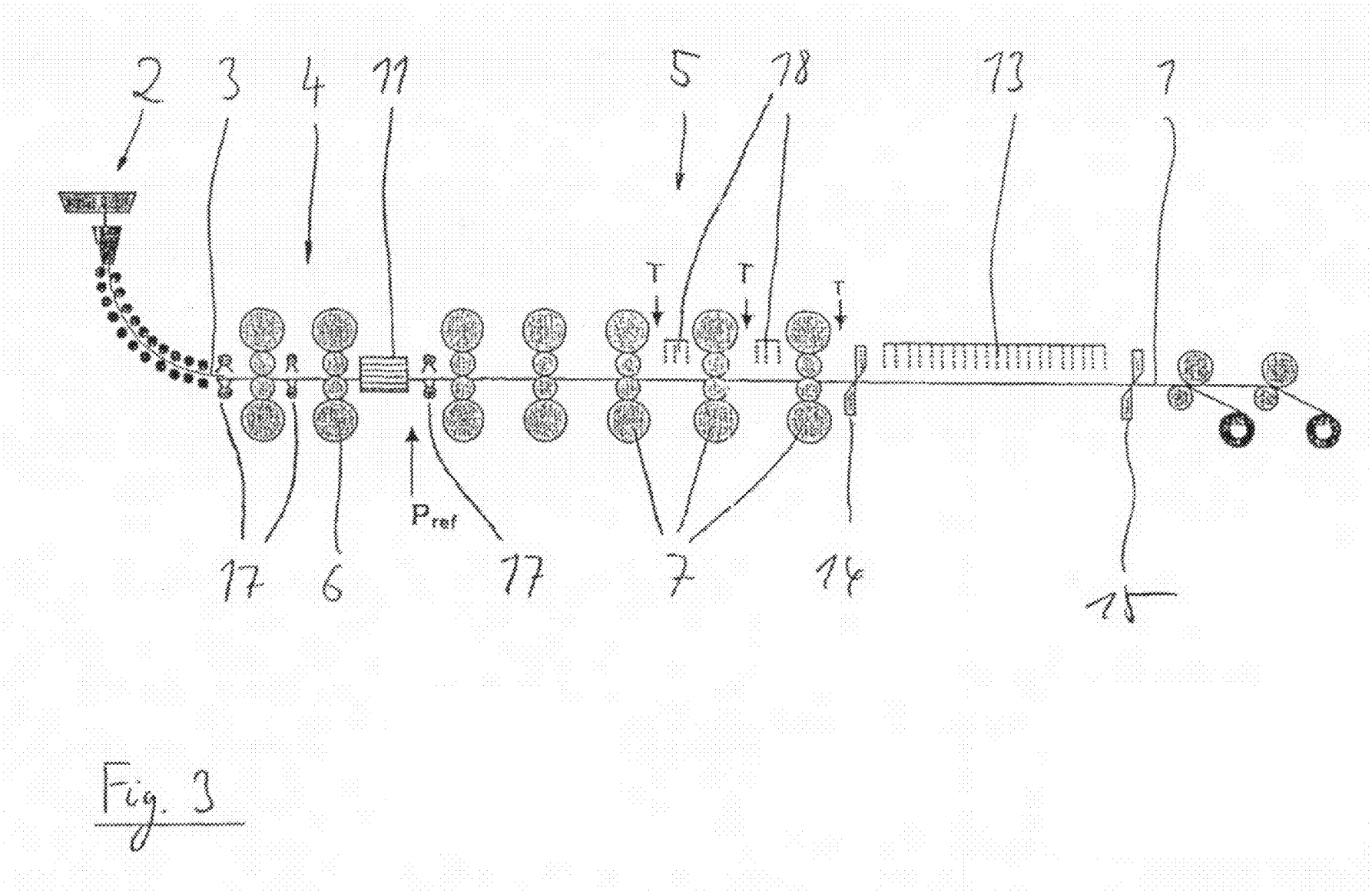
Figure 4:
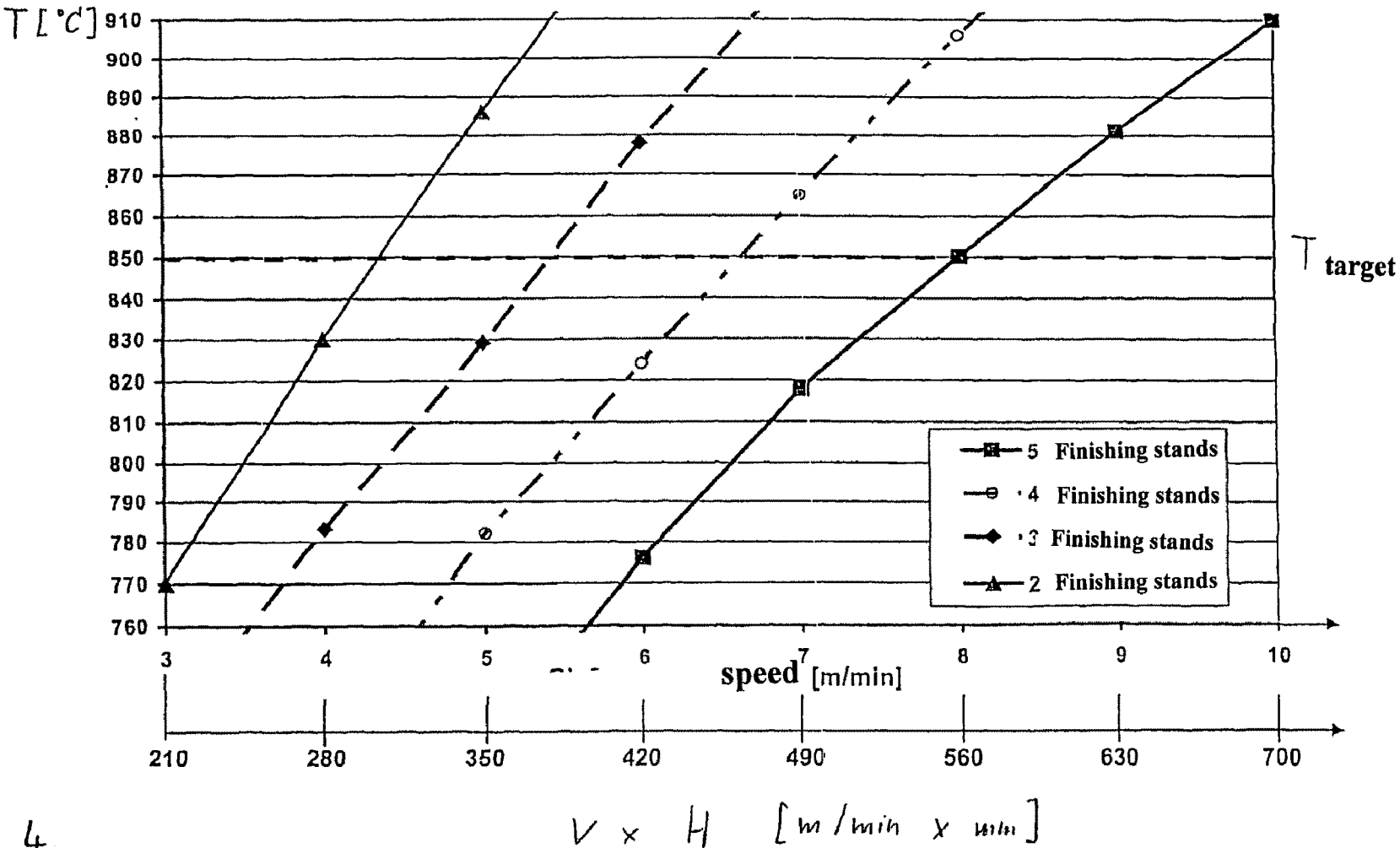
Figure 5:
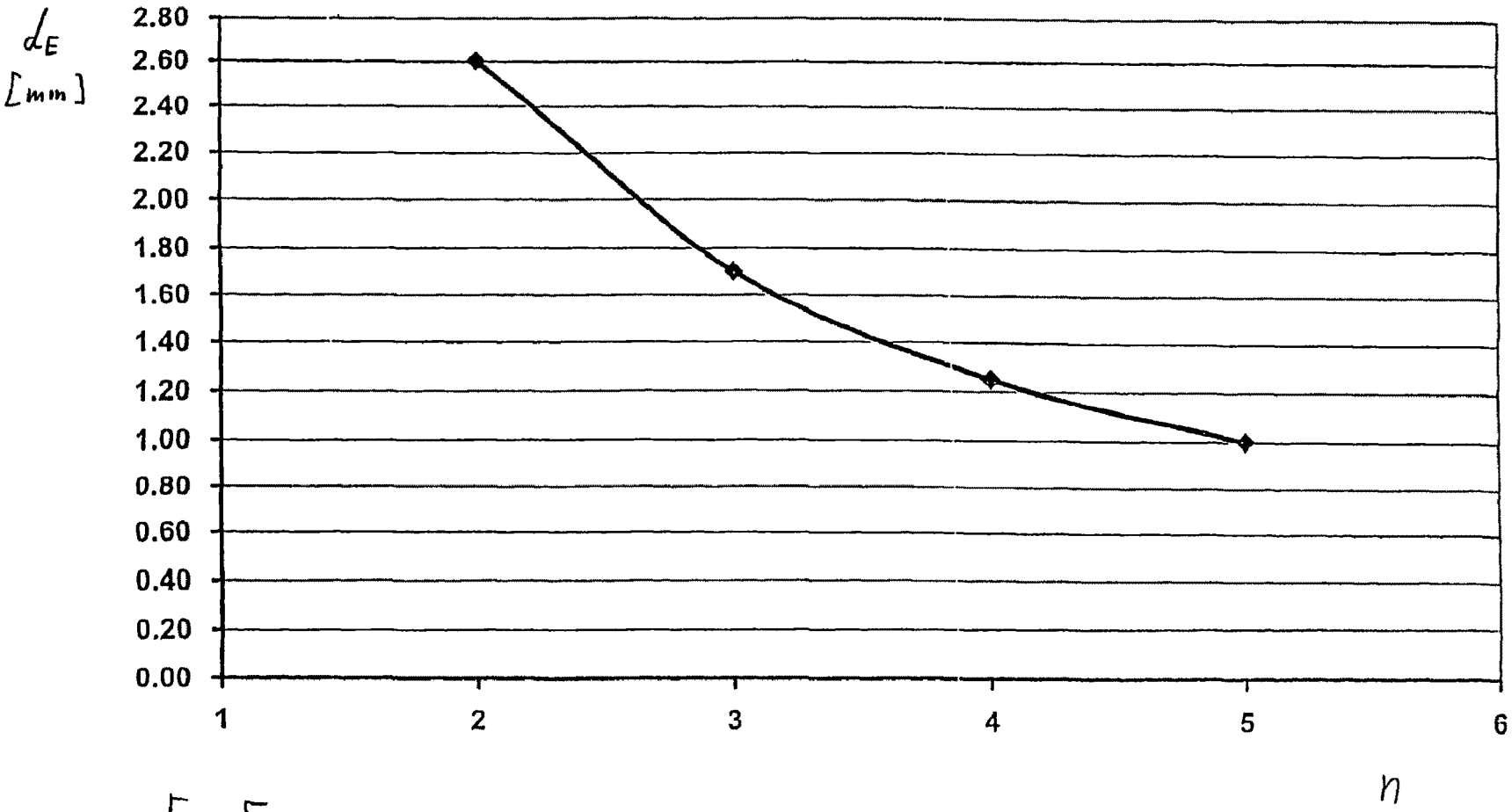
Figure 6:
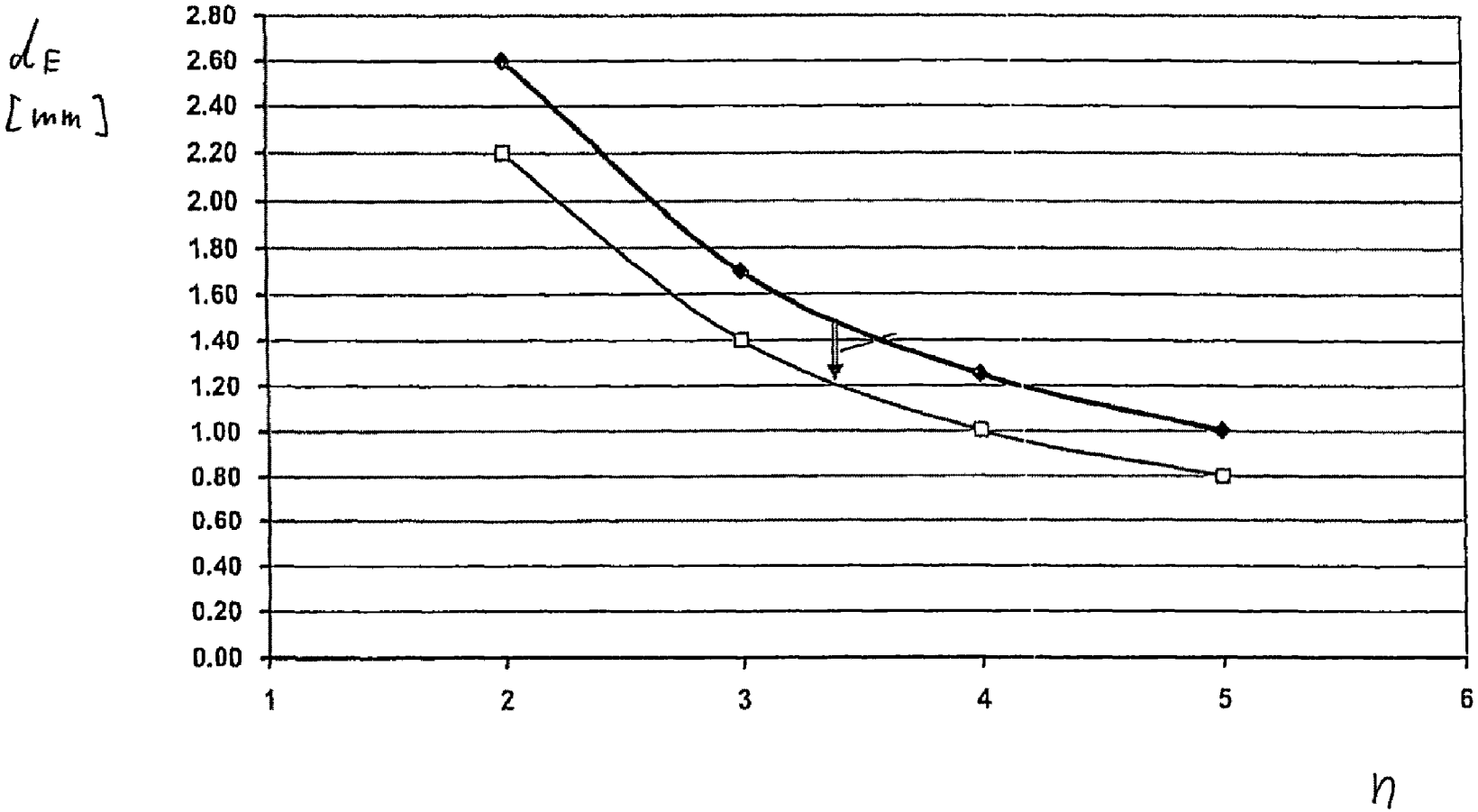

Exemplary embodiments of the invention are shown in the drawing. In the figures, FIG. 1 shows schematically a cast rolling installation according to a first embodiment of the invention with a caster, roughing train and finishing train, FIG. 2 shows an alternative configuration of the cast rolling installation to FIG. 1, FIG. 3 shows a further alternative, more compact configuration of the cast rolling installation to FIG. 1, FIG. 4 shows a functional profile of the strip final temperature stored in a machine controller as a function of the casting speed or of the mass flow for different numbers of active finishing stands, FIG. 5 shows the profile of the strip thickness as a function of the number of active finishing stands and FIG. 6 shows the profile of the strip thickness as a function of the number of active finishing stands with greater loading of the finishing stands.

In FIG. 1 a cast rolling installation is sketched, with which a strip 1 is fabricated. The installation comprises a caster 2, with which a slab 3 is continuously cast. The slab 3 emerges vertically downwards from a mould 9 and is redirected in the horizontal direction in a known manner. A first rolling train 4 with two rolling stands 6 is arranged here. A first set of shears 10, a heater 11 in the form of an inductive heater or a roller hearth furnace and a second set of shears 12 follow.

A finishing train 5 starts downstream of the second set of shears 12, which finishing train has a number n of finishing stands 7. Downstream of the finishing train 5 there is a cooling zone 13, with sets of shears 14 and 15 being arranged upstream and downstream of this. Winders 16 follow at the end of the installation in a known manner.

The critical parameter of the process is the casting speed v, at which the cast strand exits the continuous caster 2. Furthermore, the mass flow, expressed as a product of the casting speed v with the slab thickness H, is a relevant criterion (the width and density of the product is set in good approximation as constant). The slab 3 is rolled to form the strip 1 with the final thickness $d_E$ at the end of the installation.

Not shown are pyrometers, with which the temperature T downstream of the individual finishing stands 7 can be measured. Separate cooling apparatuses 18 are arranged between some of the rolling stands 7.

The installation shown in FIG. 2 differs from that according to FIG. 1 only by the number of rolling stands 6 in the roughing train 4. In the solution according to FIG. 3, the rolling train is very compact and the heating zone 11 is configured to be shorter and as an induction heater. Alternatively, a conventional compensation furnace or heater can also be arranged upstream of the compact finishing train according to FIG. 3.

In all three cases, a reference position $P_{ref}$ is defined, which lies directly upstream of the finishing train 5. If there are more than five stands downstream of the reference position $P_{ref}$, the same procedure applies. Additional stands however require a higher mass flow.

A machine controller 8—as can be seen in FIG. 1—detects the casting speed v or the mass flow v×H and the temperature T at the outlet of the finishing stands 7 of the finishing train 5 and specifies this data. The machine controller 8 can influence the employment of the individual rolling stands 6, 7 and in particular open the downstream rolling stands 7 of the finishing train 5, as long as this is technically sensible.

As already explained, the rules to be applied, that is, the functional profiles, are stored in the machine controller 8 in a computer model, which is used for the control and regulation of the process. The rules to be applied, in particular for the relationship between casting speed v or mass flow v×H (as the product of casting speed v and the slab thickness H) and the finishing train outlet temperature T, are produced in this case as can be seen in FIG. 4 for different numbers of stands. The illustration in FIG. 4 therefore shows the dependence between the casting speed or mass flow and the achievable temperature downstream of the last active stand, with this being shown for different numbers of active rolling stands.

It should be mentioned that the illustration according to FIG. 4 is of course given in each case for a concrete application; other curve profiles are produced for other applications. In the exemplary embodiment according to FIG. 4 it is a soft carbon steel, which has an mean temperature upstream of the finishing stands (at the reference position $P_{ref}$) of 1,200° C. and which, with a casting thickness of 70 mm downstream of the continuous casting installation, has an intermediate thickness of 8 to 18 mm. The maximum strip width of this installation is approximately 1,600 mm. From the viewpoint of optimum processing technology, a target finishing temperature for this steel of for example 850° C. is aimed for, which is given by the horizontal dashed line. For a given casting speed or for a given mass flow (v×H), the number of stands used can be read off at the level of the target temperature (horizontal line $T_{targ}$). The target finishing temperature varies depending on the material.

The quantitative relationships shown in FIG. 4 can apply with a mass flow spread v×H of +−20%, an intermediate temperature of <1,300° C. at the point $P_{ref}$, an intermediate thickness of 8-18 mm, a slab thickness of 50-100 mm, and the final rolling temperature $T_{targ}$ can vary depending on the material.

The achievable minimum final thickness $d_E$ of the strip 1, which is produced when using a defined number n of finishing stands 7, can be seen in FIG. 5. The graphic to be seen here is also relevant for an individual case and in the present case again shows soft carbon steel with the technological data stated in the explanation relating to FIG. 4.

In this case the finishing stands can be subjected to greater loading, so that a lower strip thickness $d_E$ can also be achieved with a given number n of active rolling stands. This situation is illustrated in FIG. 6: If the rolling stands are subjected to greater loading, the upper curve in FIG. 6 is pushed towards the lower curve, which is indicated by the arrow. With higher material strength or a wider strip, the curve is shifted in the direction of greater final thicknesses in order to keep the loading within permissible limits.

In the exemplary embodiment shown, starting from a casting thickness of 70 mm, an intermediate thickness is produced, which is approximately 8 to 18 mm upstream of the finishing train, depending on the number of roughing stands used and the selected thickness distribution. The remaining reduction takes place in the finishing train to the finishing strip thickness $d_E$, which is dependent on the number of stands used downstream of the reference position $P_{ref}$. In this case too, the minimum final thickness which can be produced varies depending on the dimensioning of the stands and drives or on the process and installation limits.

It can be technologically advantageous if the strip to be rolled is subjected to intermediate heating. Changes in the curve profiles shown can then be taken into account correspondingly in the computer model.

The stored computer model is capable of learning; the parameters can be adapted depending on the measured finishing temperature and other process parameters. Furthermore it appears that the course of the curves varies depending on for example the quantity of cooling water used, the quantity of cleaning water used, the distance between the stands, the diameter of the working rollers and the roller temperatures or else the material strength.

The casting installation 2 supplies the rolling train 4, 5 arranged downstream continuously with material. For the feeding process and for normal production mode, the process parameters are determined as a function of the settable casting speed or mass flow (product of thickness of the slab and the speed).

For a soft carbon steel, the operation brought about by the machine controller 8 looks for example as follows (the casting thickness can in this case be different from the 70 mm mentioned above):

- at a mass flow of H×v of less than 280 mm m/min: unusable operation, that is, chopping of the strip or cutting of plates at the shears upstream of the finishing train.
- at a mass flow of H×v between 280 and 380 mm m/min: good strip can be manufactured with 2 finishing stands (downstream of $P_{ref}$) and setting of heating power (induction heating, furnace) upstream of the finishing train or intermediate heating so that the desired final rolling temperature of in this case 850° C. can be set.
- at a mass flow of H×v between 380 and 450 mm m/min: good strip can be manufactured with 3 finishing stands (downstream of $P_{ref}$) and setting to final rolling temperature by means of suitable intermediate heating.
- at a mass flow of H×v between 450 and 560 mm m/min: good strip can be manufactured with 4 finishing stands (downstream of $P_{ref}$) and setting to final rolling temperature by means of suitable intermediate heating.
- at a mass flow of H×v of greater than 560 mm m/min: good strip can be manufactured with 5 finishing stands (downstream of $P_{ref}$) and setting to final rolling temperature of in this case 850° by means of suitable intermediate heating.

In order to retain the desired strip surface quality, a maximum reference temperature at position $P_{ref}$ of 1,200° is assumed here.

In order to optimise the cooling of the finishing strip in particular with a plurality of open stands and ensure that the finishing strip is cooled as soon as possible, intermediate stand coolers 18 are provided between the last stands. These are used to improve the product properties. The desired respective final rolling temperature of the finishing strip is monitored with pyrometers downstream of the in each case last active rolling stand.

If a final rolling temperature is to be produced which is higher than for example 850° C. (as targeted in the exemplary embodiment), then the effect of a gain in temperature is possible by opening a stand in accordance with the illustration in FIG. 4; finishing is then therefore carried out with one stand fewer. The "jump in temperature" is produced in FIG. 4 by dropping vertically at a given casting speed or a given mass flow from one curve to the following curve, which reproduces the profile with one fewer stand.

As a rule, the optimum or maximum casting speed for different materials is known from experimentation, so that the correct targets can be selected from the start. At an attainable casting speed of for example approximately 6.5 m/min and a casting thickness of 70 mm, the last stand of the finishing train is raised in order to come close to the target finishing train temperature. That is, the roughing stands are used to roll an intermediate thickness of 8 to 18 mm and then finishing takes place as a rule with only 4 finishing stands.

This procedure can be planned previously. In the event of problems in the continuous casting installation and an associated reduction in the casting speed, there is however a change in the thickness within a strip. If the casting process has stabilised again, and the casting speed exceeds the predefined minimum value, the setting according to FIG. 4 again takes place as soon as a new strip starts to be rolled. The strip region with the "wrong" thickness is stored in order to be able to cut out this section of the strip later.

Raising of a rolling stand is to be understood here as the situation where the working rollers of the stand are separated from each other in such a manner that no rolling of the slab or strip takes place in this rolling stand.

LIST OF REFERENCE SYMBOLS

1 strip
2 caster
3 slab
4 rolling train
5 rolling train
6 rolling stand
7 rolling stand
8 machine controller
9 mould
10 shears
11 heater
12 shears
13 cooling zone
14 shears
15 shears
16 winder
17 cleaning apparatus
18 cooling apparatus
v casting speed
H slab thickness
$d_E$ final strip thickness
T strip temperature
n number of active rolling stands
$t_{crit}$ critical time
$\Delta F_W$ differential rolling force
$P_{ref}$ reference position

The invention claimed is:

1. Method for fabricating a steel strip, in which firstly a slab is cast in a caster, with the slab exiting the caster at a casting speed (v) with a given slab thickness (H), with the slab then being rolled to form a strip in at least one rolling train having a number of rolling stands and the strip having a final thickness ($d_E$) downstream of the last rolling stand, characterized in that the method has the following steps:

a) providing a functional relationship in a machine controller between the casting speed (v) or the mass flow as a product of the casting speed and slab thickness or as a product of strip speed and the strip thickness, and the strip temperature (T) downstream of the last rolling stand, which rolls the strip, for a different number (n) of active rolling stands and different final thicknesses;

b) determining or specifying the casting speed (v) or the mass flow (v×H) and feeding the determined value into the machine controller;

c) determining the optimum number of active rolling stands and the final thicknesses and thickness reductions which can be rolled with them in the rolling train using the functional profiles stored in accordance with step a) in the machine controller in order to achieve a desired strip temperature (T) downstream of the last active rolling stand at the given casting speed (v) or at the given mass flow (v×H);

d) raising a number of rolling stands in the rolling train so that only the number of rolling stands determined in accordance with step c) are active, wherein a rolling stand is raised based on a predefined differential rolling force (ΔFw) exceeding a threshold value, with the raised rolling stand being taken into account in step c).

2. Method for fabricating a steel strip, in which firstly a slab is cast in a caster, with the slab exiting the caster at a casting speed (v) with a given slab thickness (H), with the slab then being rolled to form a strip in at least one rolling train having a number of rolling stands and the strip having a final thickness ($d_E$) downstream of the last rolling stand, characterized in that the method has the following steps:

a) providing a functional relationship in a machine controller between the casting speed (v) or the mass flow as a product of casting speed and slab thickness or as a product of strip speed and the strip thickness, and the strip temperature (T) downstream of the last rolling stand, which rolls the strip, for a different number (n) of active rolling stands and different final thicknesses;

b) determining or specifying the casting speed (v) or the mass flow (v×H) and feeding the determined value into the machine controller;

c) determining the optimum number of active rolling stands and the final thicknesses and thickness reductions which can be rolled with them in the rolling train using the functional profiles stored in accordance with step a) in the machine controller in order to achieve a desired strip temperature (T) downstream of the last active rolling stand at the given casting speed (v) or at the given mass flow (v×H);

d) raising a number of rolling stands in the rolling train so that only the number of rolling stands determined in accordance with step c) are active, wherein a rolling stand is raised based on an integral product of a predefined differential rolling force (ΔFw) and a predefined critical time, with the raised rolling stand being taken into account in step c).

3. Method for fabricating a steel strip, in which firstly a slab is cast in a caster, with the slab exiting the caster at a casting speed (v) with a given slab thickness (H), with the slab then being rolled to form a strip in at least one rolling train having a number of rolling stands and the strip having a final thickness ($d_E$) downstream of the last rolling stand characterized in that the method has the following steps:

a) providing a functional relationship in a machine controller between the casting speed (v) or the mass flow as a product of the casting speed and slab thickness or as a product of strip speed and the strip thickness, and the strip temperature (T) downstream of the last rolling stand, which rolls the strip, for a different number (n) of active rolling stands and different final thicknesses;

b) determining or specifying the casting speed (v) or the mass flow (v×H) and feeding the determined value into the machine controller;

c) determining the optimum number of active rolling stands and the final thicknesses and thickness reductions which can be rolled with them in the rolling train using the functional profiles stored in accordance with step a) in the machine controller in order to achieve a desired strip temperature (T) downstream of the last active rolling stand at the given casting speed (v) or at the given mass flow (v×H);

d) raising a number of rolling stands in the rolling train so that only the number of rolling stands determined in accordance with step c) are active, wherein a rolling stand is raised based on an unevenness, which exceeds a predetermined amount, is detected on the strip at this rolling stand, with the raised rolling stand being taken into account in step c).

4. Method for fabricating a steel strip, in which firstly a slab is cast in a caster, with the slab exiting the caster at a casting speed (v) with a given slab thickness (H), with the slab then being rolled to form a strip in at least one rolling train having a number of rolling stands and the strip having a final thickness ($d_E$) downstream of the last rolling stand, characterized in that the method has the following steps:

a) providing a functional relationship in a machine controller between the casting speed (v) or the mass flow as a product of the casting speed and slab thickness or as a product of strip speed and the strip thickness, and the strip temperature (T) downstream of the last rolling stand, which rolls the strip for a different number (n) of active rolling stands and different final thicknesses;

b) determining or specifying the casting speed (v) or the mass flow (v×H) and feeding the determined value into the machine controller;

c) determining the optimum number of active rolling stands and the final thicknesses and thickness reductions which can be rolled with them in the rolling train using the functional profiles stored in accordance with step a) in the machine controller in order to achieve a desired strip temperature (T) downstream of the last active rolling stand at the given casting speed (v) or at the given mass flow (v×H);

d) raising a number of rolling stands in the rolling train so that only the number of rolling stands determined in accordance with step c) are active, wherein a rolling stand is raised based on a surface marking, which exceeds a predetermined amount, is detected on the strip at this rolling stand, with the raised rolling stand being taken into account in step c).

5. Method according to one of claims 1 through 4, characterized in that the functional relationship is obtained by means of a computer model.

6. Method according to one of claims 1 through 4, characterized in that the strip to be rolled is heated upstream of a finishing train or a finishing train section, so that it has a defined intermediate temperature at the position $P_{ref}$.

7. Method according to one of claims 1 through 4, characterized in that the strip to be rolled is cooled on one or both sides at least between two rolling stands of the finishing train.

8. Method according to claim 7, characterized in that the strip is cooled between the last rolling stands of the finishing train.

9. Method according to claim 8, characterized in that the strip (1) is cooled between the last two rolling stands of the finishing train.

10. Method according to one of claims 1 through 4, characterized in that the temperature of the strip is measured downstream of the last active rolling stand, and the measured value is fed to the machine controller.

11. Method according to one of claims 1 through 4, characterized in that a roller change is carried out on a raised rolling stand while production continues.

12. Method according to one of claims 1 through 4, characterized in that when a rolling stand fails, it is raised.

13. Method according to one of claims 1 through 4, characterized in that the strip partitions of unequal thickness or temperature are cut out by shears.

* * * * *